US005263716A

United States Patent [19]

Smyth

[11] Patent Number: 5,263,716

[45] Date of Patent: * Nov. 23, 1993

[54] MULTIPLE TIER GAMING MACHINE

[75] Inventor: Richard E. Smyth, Kyle Bay, Australia

[73] Assignee: Ainsworth Nominees Pty. Limited, New South Wales, Australia

[ * ] Notice: The portion of the term of this patent subsequent to Apr. 7, 2009 has been disclaimed.

[21] Appl. No.: 824,118

[22] Filed: Jan. 23, 1992

Related U.S. Application Data

[63] Continuation-in-part of Ser. No. 476,048, Feb. 8, 1990, Pat. No. 5,102,134.

[51] Int. Cl.[5] ..... A63F 5/04

[52] U.S. Cl. ..... 273/138 A; 273/143 R

[58] Field of Search ..... 273/138 A, 138 R, 143 R; 364/410, 412

[56] References Cited

U.S. PATENT DOCUMENTS

| | | | |
|---|---|---|---|
| 4,448,419 | 5/1984 | Telnaes | 273/143 R |
| 4,492,379 | 1/1985 | Okada | 273/138 A |
| 4,527,798 | 7/1985 | Siekierski et al. | 273/138 A |
| 4,573,681 | 3/1986 | Okada | 273/143 R |
| 4,657,256 | 4/1987 | Okada | 273/138 A |
| 4,679,143 | 7/1987 | Hagiwara | 273/138 A |
| 4,711,451 | 7/1986 | Pajak et al. | 273/138 A |
| 4,772,023 | 3/1986 | Okada | 273/138 A |
| 4,858,932 | 8/1989 | Keane | 273/143 R |
| 5,102,134 | 4/1992 | Smyth | 273/138 A |
| 5,108,099 | 4/1992 | Smyth | 273/138 A |

*Primary Examiner*—Jessica J. Harrison

*Attorney, Agent, or Firm*—Nikaido, Marmelstein, Murray & Oram

[57] ABSTRACT

A gaming machine is provided in which the symbols/indicia to be displayed are selected by using a random selection process to generate a random number element for each display position. The process is a two-step selection process. In a first selection process random numbers are chosen from a first table of random numbers, elements of which are mapped directly to reel stopping positions and at least one element of which if generated, causes a second selection step. The second selection step is between a further stopping position, not available in the first selection step, and an alternative stopping position which is preferably also available in the first selection step. The stopping position not available in the first selection step may be associated with a jackpot symbol. The frequency of occurrence of a jackpot symbol can be reduced by this method, and an appropriately high jackpot can therefore be offered.

38 Claims, 8 Drawing Sheets

| SOFTWARE POSITIONS | REEL STRIP |
|---|---|
| 1 | JACK |
| 2 | QUEEN |
| 3 | 9 |
| 4 | 8 |
| 5 | 10 |
| 6 | QUEEN |
| 7 | KING |
| 8 | QUEEN |
| 9 | JACK |
| 10 | 7 |
| 11 | KING |
| 12 | ACE |
| 13 | 9 |
| 14 | 8 |
| 15 | QUEEN |
| 16 | JACK |
| 17 | 9 |
| 18 | KING |
| 19 | ACE |
| 20 | 8 |
| 21 | 10 |
| 22 | QUEEN |
| 23 | JACK |
| 24 | KING |
| 25 | QUEEN |

FIG.8

MULTIPLE TIER GAMING MACHINE

The present application is a continuation-in-part of application Ser. No. 07/476048 filed on Feb. 8, 1990 in the name of Richard Edward Smyth, now U.S. Pat. No. 5,102,134.

BACKGROUND OF THE INVENTION

The present invention relates to gaming machines, in particular to gaming and slot machines such as poker machines, fruit machines, video gaming machines, video draw card poker machines and the like. In particular, the invention relates to an improved gaming machine wherein the probability of winning combinations occurring may be altered with regard to conventional machines without changing the number of actual symbols or indicia available e.g. the predetermined number of symbols which are available on a rotatable reel or reel-type gaming machine, or alternatively, that the number of physical symbols or indicia may be decreased with a consequential increase in symbol size where the symbols are mounted on a reel, without altering the probability of winning combinations provided on the machine occurring.

The invention particularly, but not exclusively, relates to slot machines common to casinos and clubs where the player inserts coins into the machine and spins at least one rotatably reel by handle or button whereupon the reel or reels become stopped at random, and if the stop symbols coincide with the pay schedule or score card the player is paid a prize. If it is a multi-coin machine the player may buy extra chances or multiply potential winnings.

In a preferred embodiment the present invention applies to slot machines with reels, the stopping position of which is random but under the control of a microprocessor; machines of this type are described in British patent No. 1550732 by PBR and U.S. Pat. No. 4095795 by Saxton.

In a bid to attract players, casinos have offered higher and higher jackpots, and as these are a percentage of revenue the chances of striking a jackpot have to be proportionally less. This was attained in the past, in reel machines, by increasing the number of reels and/or increasing the number of symbols on a reel.

With the development of microprocessor controlled slot machines, where the stopping position of a reel is determined by the microprocessor, a new approach was taken. Telnaes U.S. Pat. No. 4,448,419 selected stopping positions from a virtual reel strip or memory table within the microprocessor which had more virtual positions than there were physical stop positions on the reel itself. By mapping several of these virtual positions to one of the reel symbols, the probability of the reel showing one symbol became different to that for showing others of the symbols. For example, a jackpot symbol can be made to appear with less frequency than other symbols.

With the same intention U.S. Pat. No. 4,858,932 (Keane) selects the real stopping position from a series of random numbers divided into the same number of groups as there are real positions; however the size of each group is unequal thereby causing the appearance of a jackpot or other symbol to be of unequal probability of appearing on a pay line.

Kabushiki Kaisha Universal also describe an arrangement in their Australian Patent No. 561873 in which the slot machine periodically checks the prize value paid by the machine over the preceding period and if this value is too high, the machine adjusts the operation of the machine to make it harder for the player to win. The Kabushiki Kaisha Universal machine is of the type where the reels are stopped under player control by the player pressing a stop button and winning is made harder by introducing a delay in the reel stopping sequence after the stop button is pressed.

SUMMARY OF THE INVENTION

The present invention relates in particular to a process and apparatus for selecting symbols appearing on the display of a gaming machine.

The present invention provides a gaming machine comprising control means for controlling operation of the machine, display means including a plurality of display positions for displaying combinations of indicia and reward means for returning a reward to a player of the machine in response to certain predetermined indicia combinations being displayed on the display means at the end of a game, the display means including a separate indicia display means for each display position, each indicia display means being response to the control means to display an indicium at the end of the game which is selected by the control means from a set of possible indicia, and the control means including indicia selection means for making that selection for each of the display positions, wherein, for at least one display position, a two tier selection process is employed whereby the set of indicia is divided into at least two subsets and the indicia selection means comprises first random number selection means for selecting a random number from a set of random numbers having members each of which uniquely corresponds to one member of a first of said subsets of the set of indicia plus additional numbers each of which uniquely corresponds to one of the remaining subsets of indicia, and second random number selections means, which is invoked only in the event of the first random number selection means selecting a number corresponding to one of said remaining subsets, the second random number selection means being arranged to select a number from a set of numbers each of which uniquely corresponds to one indicia in said one of said remaining subsets of indicia, and the display means being arranged to display the indicium corresponding to the number selected by the first random number selection means if the random number selected by the first random number selections means is a number corresponding to a member of said first of said subsets, and being arranged to display the indicium corresponding to the number selected by the second random number selection means, if the number selected by the first random number selection means is a number corresponding to one of the remaining subsets.

The system of the present invention has the advantage that the chances of a predetermined indicia being displayed at a display position can be predetermined and can be made less than the chances of appearance of the other available indicia, if required. For example, the frequency of appearance of a jackpot symbol (an indicia which it is necessary to display in order to win a jackpot prize) may be made less than the frequency of appearance of the other symbols by utilizing the present invention. The jackpot indicia would be made a member of one of the plurality of subsets so that if the first selection generated a number corresponding to the particular subset, it still would not be certain that the jackpot symbol would be chosen, as a second selection process (which may be weighted) has to take place.

The invention of the parent application also relates to an indicia selection scheme for a gaming machine in which at least a two step selection process takes place, the first selection step being between a first subset and at least one remaining subset. However, none of the indicia in the remaining subsets can be chosen by the first selection step. Only that particular remaining subset can be chosen in the first selection step. A further step is necessary to choose one of the indicia from the subset.

A problem with the indicia selection scheme of the invention of the parent application is that it can lead not only to the desired reduction in frequency of the appearance of a jackpot symbol, but also a reduction in appearance of the indicia contained in the same remaining subset as the jackpot symbol, which themselves may not be prize winning symbols. The reduction in frequency of their appearance can give rise to problems in the combination of the machine.

The present invention preferably provides a scheme whereby indicia in the remaining subsets may also belong to the first subset so that they may be chosen by the first selection step and the second selection step. In this way, other symbols in the remaining subsets which are not prize winning symbols can also be members of the first subset and be chosen by the first selection process, meaning that their frequency of appearance is substantially unaffected. The jackpot symbol, however, would remain a member of a remaining subset only.

The present invention further provides a gaming machine which incorporates this scheme.

The present invention further provides a method of selecting an indicium to be displayed on a gaming machine display, the method comprising dividing a set of possible indicia for display into a plurality of subsets, randomly selecting an element from a set of elements each of which uniquely corresponds to one of the number of indicia in a first of the subsets and the number of remaining subsets, and in the event that the selected element corresponds to one of the remaining subsets further randomly selecting an element from another set of elements corresponding in number to the number of indicia in said one of said remaining subsets and displaying the indicium corresponding to the element selected in said first or second selection, wherein at least one of the indicia in at least one of the remaining subsets is also a member of the first of the subsets, so that said at least one indicium is selectable by said first and second selection step, and at least one other indicium of the at least one remaining subsets is not a member of the first of the subsets.

Some gaming machines allow for combinations between symbols appearing on more than one display line. For example, in reel-type machines (or even in some video reel or video draw poker machines) a number of adjacent symbols may appear in one display window at one display position. They can be combined with adjacent symbols in the next display position to give more than one pay line, i.e., a centre pay line and two adjacent pay lines, one above and one below. These machines are known as multiple-line machines. Diagonal pay lines can also be implemented on these machines, i.e., three horizontal pay lines, two diagonal pay lines.

The present invention can be used with advantage in multi-line machines. In order to ensure that there is no inconsistency in the combinations available on the machine, apart from the desired reduction in frequency of the jackpot symbol, symbols normally appearing adjacent the jackpot symbol on a multi-line display are also made members of one of the remaining subsets. In a preferred embodiment, the grouping of indicia members in the subset is arranged such that the symbol of the same appearance to that appearing adjacent the jackpot symbol will appear adjacent to the alternative symbol from the subset containing the jackpot symbol, if that alternative symbol is chosen for display. This is done by making the other remaining subsets contain indicia which are of the same appearance to each other.

This scheme is also particularly applicable in multiplier machines (multi-coin machines where the amount of the prize is multiplied by the amount of stake initially inserted for game play).

The present invention further provides a gaming machine comprising control means for controlling operation of the machine, display means including a plurality of display positions for displaying combinations of indicia, the display means including a separate reel display means for each display position, each reel display means comprising a rotatable reel mounting a set of indicia thereon, each reel display means being responsive to the control means to display an indicium at the end of the game which is selected by the control means from the set of indicia mounted on the rotatably reel, wherein, for at least one display position, a two tier selection process is employed whereby the set of indicia on the reel is divided into at least two subsets, and the control means comprises first selection means for randomly selecting an element from a set of elements each of which uniquely corresponds to one indicium of a first of said subsets of the set of indicia plus additional elements each of which uniquely corresponds to one of the remaining subsets of indicia, and second selection means, which is invoked only in the event of the first selection means selecting an element corresponding to one of the remaining subsets, the second selection means being arranged to randomly select an element from a set of elements each of which uniquely corresponds to one indicium in said one of said remaining subsets of indicia, the reel display means being arranged to display the indicium corresponding to the element selected by the first selection means if the element by the first selection means, is an element corresponding to an indicium which is a member of a first of the subsets, and being arranged to display the indicium corresponding to the element selected by the second selection means, if the number selected by the first selection means is an element corresponding to one of the remaining subsets.

SHORT DESCRIPTION OF THE DRAWINGS

Features and advantages of the present invention will become apparent from the following description of embodiments thereof, by way of example only, with reference to the accompanying drawings, in which:

FIG. 1 illustrates a typical multi-line slot machine to which embodiments of the present invention may be applied;

FIG. 2 schematically illustrates a first reel mapping arrangement in accordance with an embodiment of the invention of the parent application;

FIG. 3 schematically illustrates a conventional prior art reel mapping arrangement;

FIG. 4 illustrates a flow chart for reel control in an embodiment of the parent invention making use of the mapping arrangement of FIG. 2;

FIG. 5 schematically illustrates an alternative reel mapping arrangement to that of FIG. 2;

FIG. 6 schematically illustrates a first reel mapping arrangement in accordance with an embodiment of the present invention;

FIG. 8 illustrates a further reel mapping arrangement, showing actual symbols on the reel strip of a reel machine, in accordance with the of the present invention.

DETAILED DESCRIPTION OF THE PREFERRED EMBODIMENTS

Figure 1:
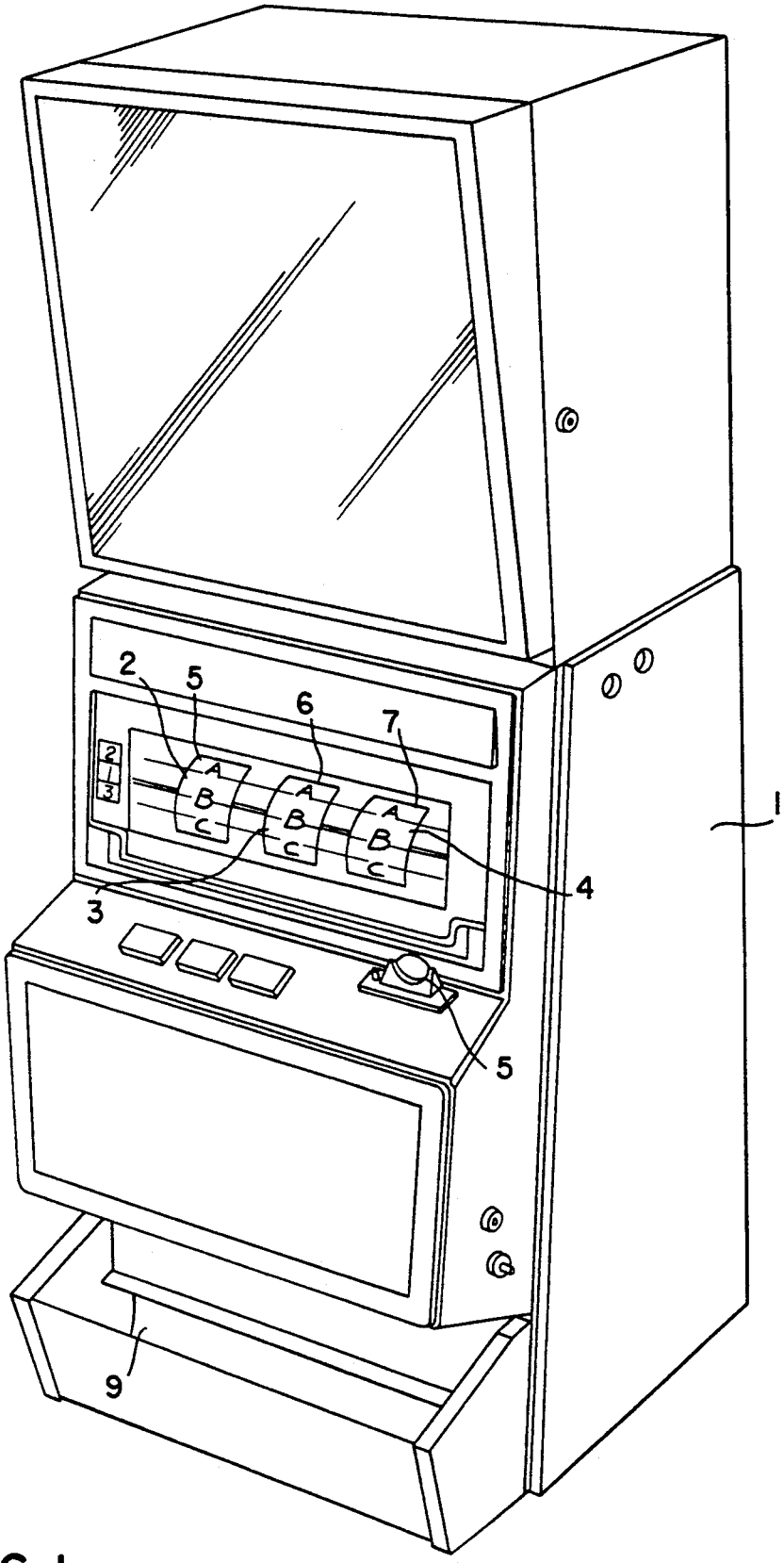

The following description of embodiments of the invention will be made with regard to reel-type slot machines, an example of which is illustrated in FIG. 1, and which are generally well known in the art. The present invention may be applied in other types of gaming machines.

Referring to FIG. 1, the slot machine consists of a housing 1 incorporating electro-mechanics (not shown) for driving the three reels 2, 3, 4 and control electronics (not shown) for controlling operation of the machine.

In response to a credit in a credit meter (a coin may be placed in coin slot 5 in order to place a credit in the credit meter) the machine is enabled for playing of a game. On activation of the game (e.g. by control button not shown) the reels 2, 3, 4 are spun electro-mechanically and stopped at positions determined randomly by the control means inside the machine.

Figure 3:
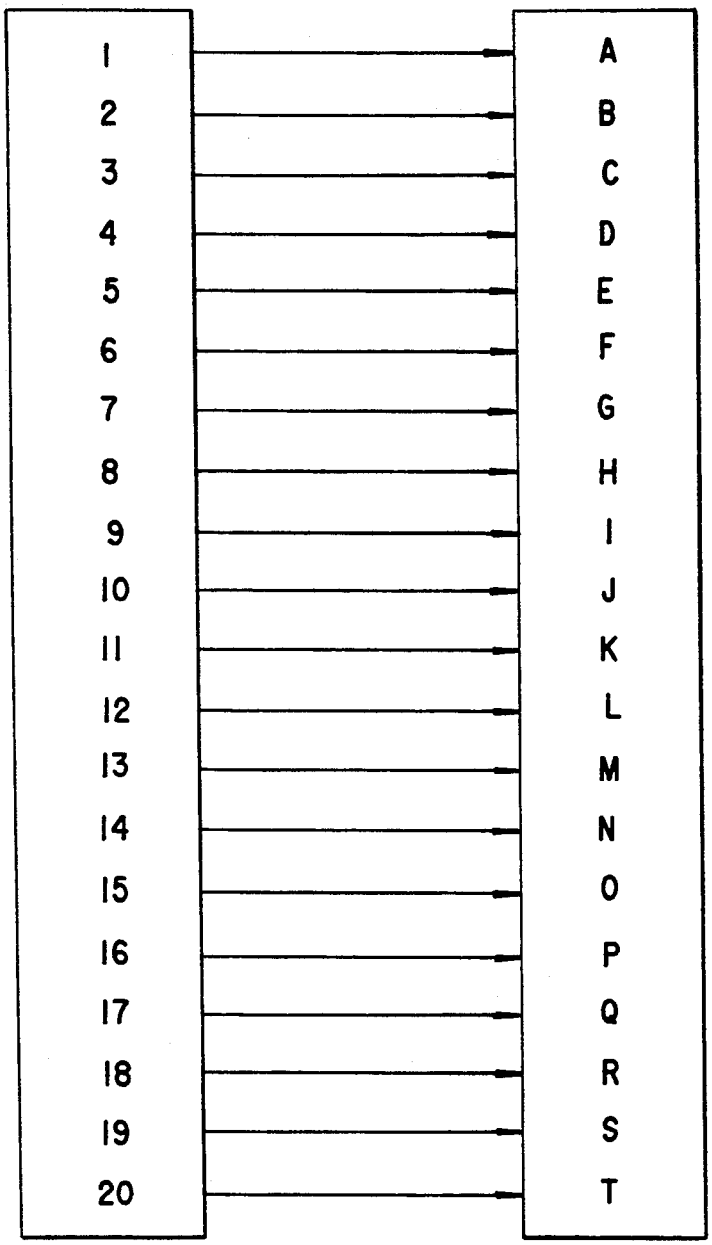

A plurality of indicia are provided on a reel strip on the outside of each reel 2, 3, 4, and when the reels are stopped the indicia appear in the display windows 5, 6, 7. The machine illustrated in FIG. 3 is a multi-line machine, where more than one indicia appear in a window 5, 6, 7.

The machine incorporates reward means (not shown) for determining, dependent upon combinations between indicia appearing in the windows 5, 6, 7, whether or not a reward should be returned to the player. If it is determined that a reward should be delivered, then it may be provided in the form of coins dropped into the coin tray 9.

In a multi-line machine, as illustrated, combinations can be made between indicia along more than one line, e.g. top line, bottom line and middle line and also along diagonal lines. A wider variation of odds and prizes can thus be offered to a user than with a single line machine.

It will, however, be appreciated that the present invention is also applicable to single line machines.

The basic principle of the present invention is to add a second step or trial when a jackpot symbol position or other nominated symbol position is about to appear on a pay line.

When the stopping of each reel is required, a random number of equal probability is selected by the microprocessor. For all but a jackpot symbol this number is mapped directly to the reel and the microprocessor stops the reel in the required position using a known technique.

I the case where the random number selected corresponds to a jackpot symbol a further random selection process is called up to decide whether the reel is to be stopped on the jackpot or whether the reel is to be stopped instead at a nominated alternative site.

Figure 2:
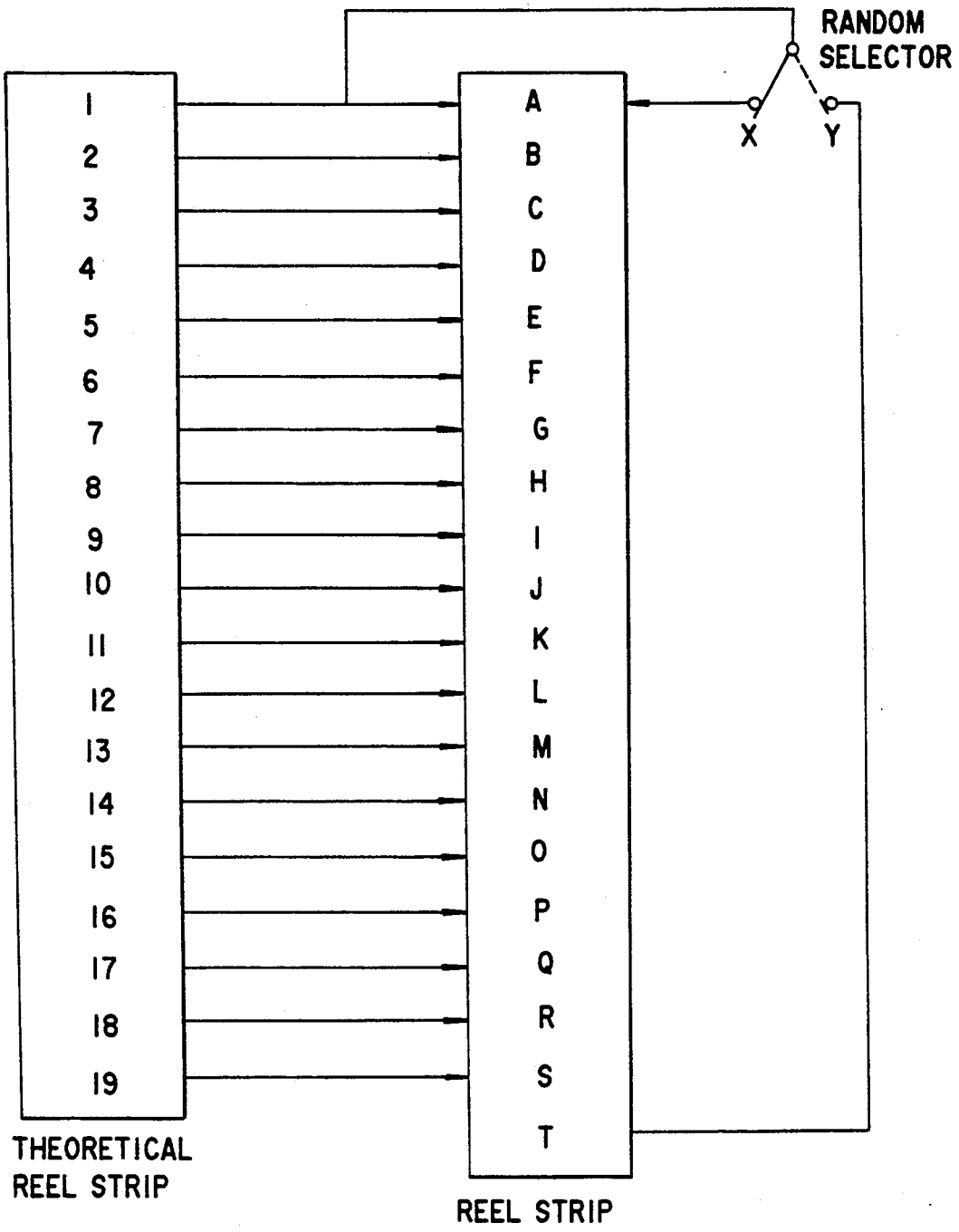

FIG. 2 shows an example of a reel which has 20 stop positions, and which is in accordance with an embodiment of the invention of the parent application. Position "A" on the reel or eel strip is a Jackpot and position "T" is the alternative nominated site.

In this case the range of random numbers which may be selected by the first random number generating means is 1 to 19 and these are shown on the memory table or "theoretical reel strip". When random numbers 2 to 19 are chosen by the microprocessor, these are mapped direct to reel positions as shown.

When random number 1 is chosen, a second, two-position random selector decides whether the reel is to be stopped at position "A" or whether it is to be stopped at position "T".

If only two random numbers are used in the above selector, the chances of position "A" and position "T" appearing are equal and each of them will appear with half the probability of symbols "B" to "S"; accordingly each could be a jackpot symbol of different kinds.

More flexibility in the planning of pays at the design stage or the ability to make an even higher jackpot can be achieved by a range of random numbers greater than 2 and which can be divided into two groups of unequal size.

For example if 100 random numbers were divided on a 40/60 basis the 20-stop reel would stop at position "A" with a probability of:

$$\frac{1}{19} \times \frac{40}{100} = (.0211)$$

It would stop at any one of positions "B" to "S" with a probability of:

$$\frac{1}{19} = (.0555)$$

It would stop at position "T" with a probability of:

$$\frac{1}{19} \times \frac{60}{100} = (.0316)$$

To prevent discouraging the player by infrequent appearance of jackpot symbol "A" or "T" in the window the preferred embodiment does not apply second tier random selection to the first reel of the slot machine.

For reel one, instead of 19 random numbers, the theoretical reel strip has 20 random numbers, each being mapped to corresponding reel positions "A" to "T" as per prior art and as shown in FIG. 3. The remaining reels are operated in accordance with the invention of the parent application.

To obtain a jackpot, a jackpot symbol is required to stop on the pay line of all reels of the slot machine and if the player fails to achieve this on the first reel to be stopped, there is not point in inhibiting this symbol on the subsequent reels. The player therefore has more encouragement and pleasure than is described in Telnaes U.S. Pat. No. 4,448,419 and Bally's 33253/89 where the frequency of jackpot symbols on the pay line is always less than for other symbols.

Figure 4:
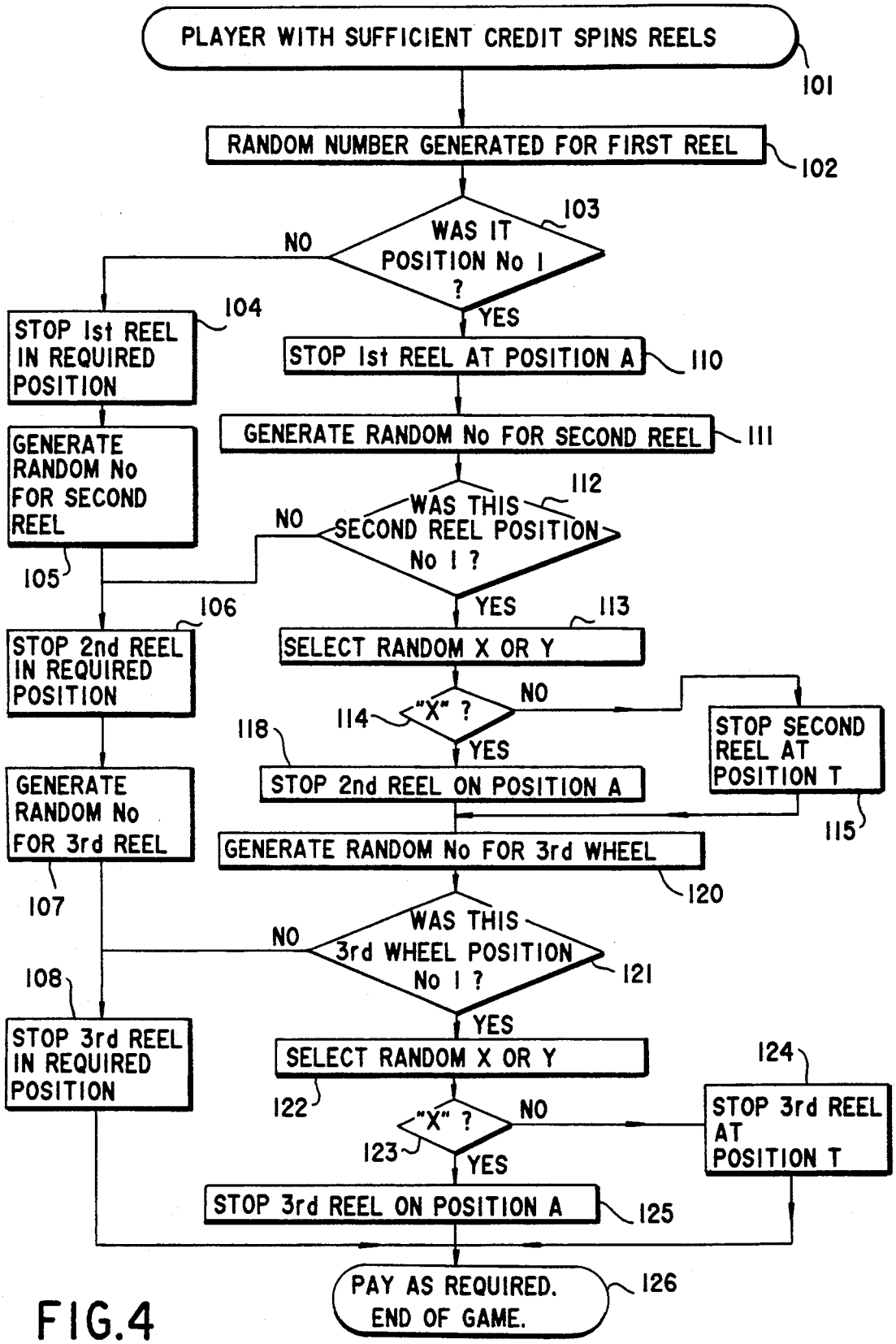

FIG. 4 is a flow chart of the preferred embodiment of the invention of the parent application. The left hand path in this flow chart shows the sequence when a jackpot symbol has not occurred on the first reel.

Referring to FIG. 4, the slot machine will enable a player (101) to operate the machine only if the player has established sufficient credit in a conventional manner. Once the player operates the machine, a random number is generated for the first reel (102) and the resulting number is tested (103) to determined if it corresponds to a jackpot symbol or not. If the first random number does not correspond to a jackpot symbol then the reel is stopped (104) and a random number is generated from a set of possible results, equal to the number of symbol positions on the reels, to determine a stopping position for the second reel (105). The second reel is then stopped (106) and a number generated for the third reel (107) and that reel is also stopped (108) in similar fashion. It will be noted that once the possibility of a jackpot is removed, by the jackpot symbol not being selected for the first position, the second and third reels are mapped in the same manner as the first without any provision for two tier symbol selection.

In the event that the jackpot symbol is selected as the stopping position for the first reel, the reel is stopped at position A (110) and a random number is generated (111) for the second reel from a set of possible results which has one less members than the reel has symbols. This number is then tested (112) and in the event that the first position was not selected the reel is stopped (106) and a number selected for the third reel (107) and that reel stopped as previously described for the non-jackpot case.

If position 1 is selected for the second reel by the first random number generation means then a further random selection (113) between two possible results (X or Y) is made and the result tested (114). When a "Y" result is achieved the second reel is stopped in the T position (115) and a number generated (120) for the third reel.

When an "X" result is achieved in the second tier selection for the second reel, the reel is stopped in the A or jackpot position (118) and a number is generated for the third reel using a set of possible results having one less members than the reel has symbols (120) as in the corresponding step (111) for the second reel. The selected number is then tested (121) and, if the number is not one, the reel is stopped (108) as per the non-jackpot case. If, however, the first tier selection for the third reel results in the number one being selected, a second tier selection (122) is made in similar manner to the second tier selection (113) for the second reel. The second tier selection is then tested (123) and if a "Y" result is obtained the third reel is stopped (124) at T. If, on the other hand, the second tier selection for the third reel is "X", the reel is then stopped at position "A" (125).

Once all reels are stopped the machine determines if a payout is required and pays (126) accordingly.

Figure 5:
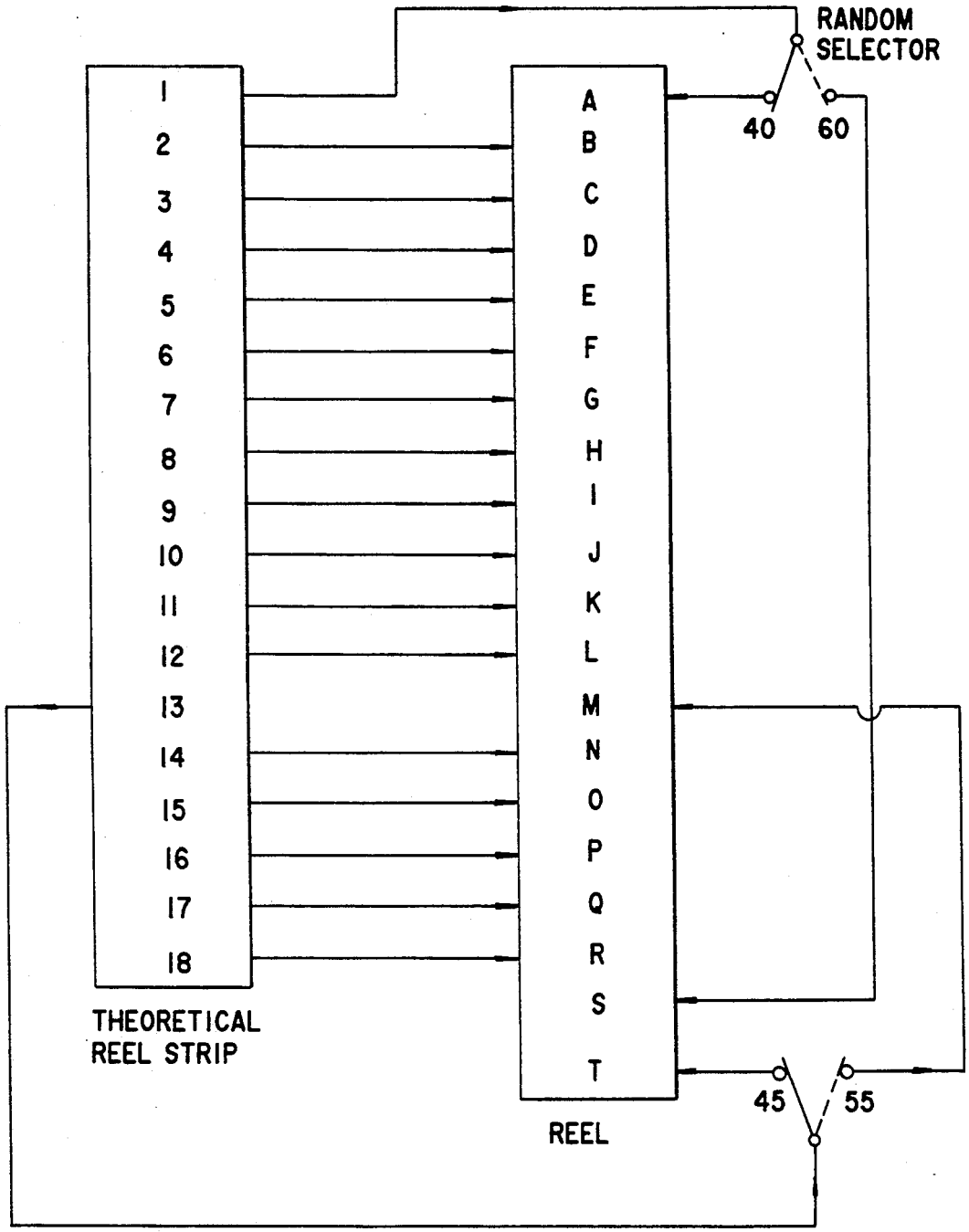

It is also possible in another embodiment to accommodate more than two jackpots "A" and "T". FIG. 5 shows one of several possible ways in which, with 18 random numbers on the theoretical reel strip, four different jackpots can be accommodated. Random number 1 on the table can create jackpot "A" and jackpot "S" via a second tier selection while random number 13 on the table can create jackpot "M" and jackpot "T" via a second tier selection.

As discussed above, in the preamble of the specification, a reel mapping scheme such as that illustrated in FIG. 2 (and the subject of the parent application) can give rise to the problem that the non-jackpot symbol (position "T") appears with reduced frequency compared to the other non-jackpot symbols. This can cause combination problems.

Figure 6:
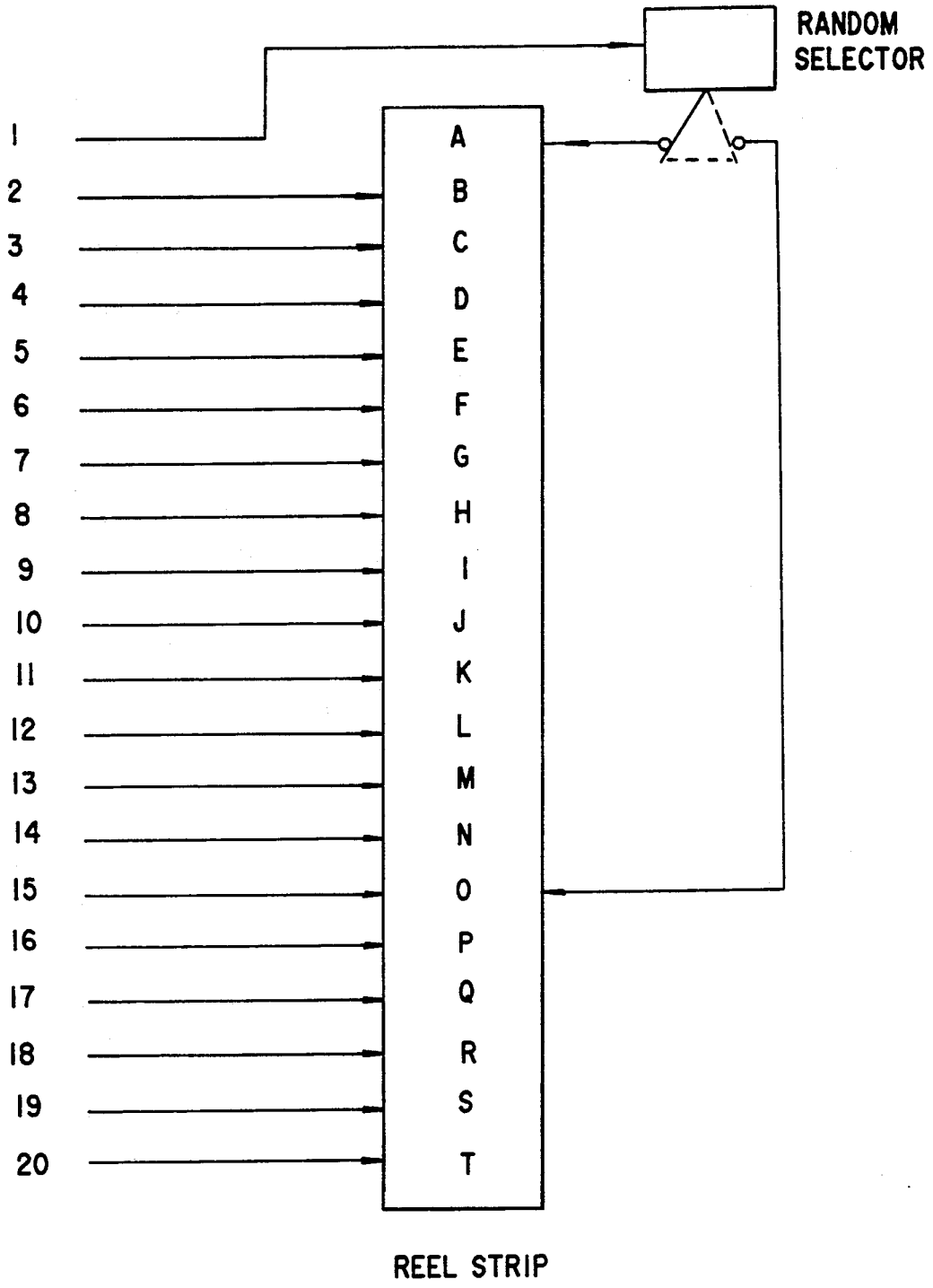

A reel mapping arrangement of a preferred embodiment of the present invention is illustrated in FIG. 6. As in FIG. 2, the reel mapping arrangement of FIG. 6 incorporates two selection steps. However, the first selection step is from random numbers 1 through 20, numbers 2 through 20 being mapped directly to reel positions and number 1 causing a further random selection to occur between reel positions "A" and "T". In this case, it can be seen that position "T" can be chosen by two methods. Either it can be selected if random number 20 is selected in the first selection step, or it can be selected if random number 1 is selected in the first selection step and then the random selector in the second selection step selects position "T". If a non-jackpot symbol appears on the reel at stopping position "T" its frequency of appearance will not substantially be any different from the frequency of appearance of the other non-jackpot symbols, "B" through "S".

The only symbol which appears with reduced frequency is the jackpot symbol, at stopping position "A".

The random selector can be weighted, as discussed in relation to the parent invention described above, and a "player encouragement" process can be operated where, if a reel which is stopped first does not display a jackpot symbol then a different selection process is operated for the other reels where the jackpot symbol may appear with normal frequency, as is also described above in relation to the parent invention.

FIG. 8 shows a reel mapping scheme in accordance with an embodiment of the invention giving information on the actual symbols appearing on the reel strip at the various stopping positions. The scheme of FIG. 8 is particularly designed for application in multi-line machines, where a prize may be won depending on a combination of symbols on more than one pay line, and also multiplier machines, being machines where the value of the prize is varied depending upon the amount of stake bet for the particular game. In multiplier machine the scheme prevents "near misses", where a symbol has a greater probability of appearing on a non-pay line than on a pay line. The scheme of FIG. 8 is for one reel only of a multiple reel machine (a "five line" machine as illustrated in FIG. 1, incorporating three horizontal pay lines and two diagonal pay lines). In a first selection step, a random number generator is arranged to choose from 25 random number ("software positions"), numbers 1 to 8 and 12 to 25 of which are directly mapped to stopping positions on the reel strip (e.g., position 6 is mapped to the appropriate stopping position on the reel strip to cause the reel to display the symbol "queen" on the centre pay line of a display. The adjacent, associated symbols, being the adjacent symbols of the reel strip, "ten" and "king", will be displayed on the other pay lines of the five line machine—see FIG. 1). If numbers 9, 10 or 11 are selected, a second random selection process takes place, in a similar manner to the second selection processes described above, i.e., the second random number generator selects between two alternative stopping positions. For example, if random number 10 is generated in the first selection step, a second selection process takes place to choose between the reel position for displaying a symbol "seven" (the jackpot symbol) and the reel position for displaying symbol "nine" (a non-jackpot symbol). In this way, the frequency of appearance of the jackpot symbol "seven" is reduced, and a higher jackpot can be offered.

Second selection steps also take place if random number 9 or random number 11 is chosen. In both these cases, however, whatever stopping position is finally chosen by the second selection step, the same symbol will appear in the centre line of the display. For example, for random number 9, a further selection is made between stopping positions, but in each case the symbol which will appear on the pay line will be a "jack". This means that in a five line multi-line, the jackpot symbol will have a reduced frequency of appearance in all five lines, by virtue of the fact that stopping positions adjacent to the jackpot symbol are also subject to a two-step selection process. It will also be seen from FIG. 8 that the symbols of the stopping positions adjacent the positions for which a two-step selection process takes place are the same, i.e., "queen" and "ace".

The embodiment of FIG. 8 for a five line multi-line allows (a) only one symbol is being mapped to another, (b) each combination has the same probability of occurring on any pay line in a multi-line (1, 2, 3, 4 or 5 lines) game, and (c) near misses are avoided. This is when a symbol has a greater probability of occurring in a non-pay line than on a pay line (this is an advantageous feature in particular for multiplier machines).

Figure 7:
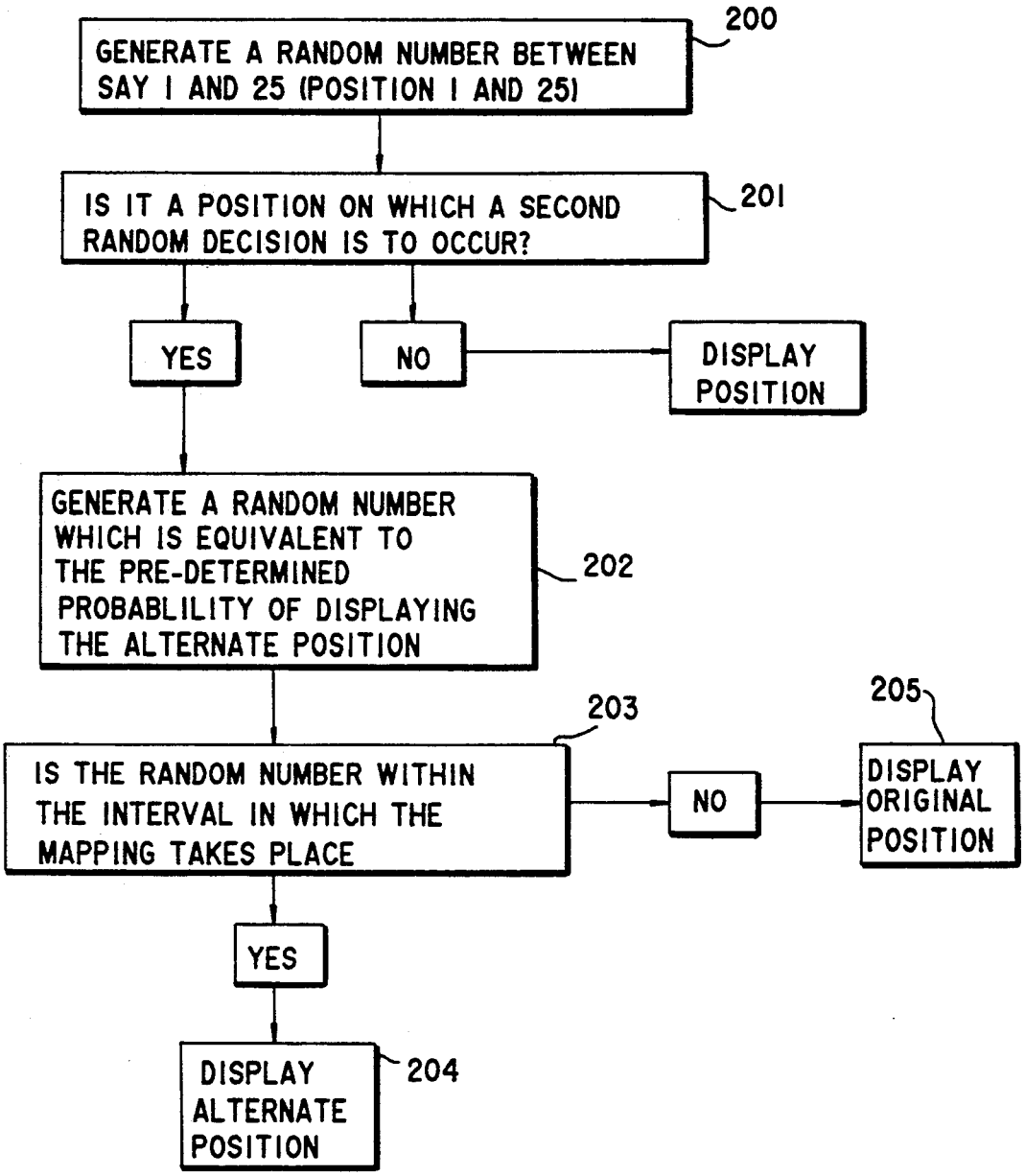
FIG. 7 illustrates a flow chart for reel control in an embodiment of the invention making use of the reel mapping arrangement of FIG. 8.

A simplified flowchart for a selection process using the reel mapping scheme illustrated in FIG. 8 is shown in FIG. 7. At 200 a random number is generated between 1 and 25. At 200 a decision is made as to whether or not the random number generated is a random number at which a second selection step should take place. If it is not, the reel is stopped at the position which the selected random number is mapped to. If it is, step 202 is taken, which involves a second selection step between two alternate stopping positions. A decision is taken at 203 whether the alternative stopping position should be chosen. If it is so chosen at 204 it is displayed. If not, at 205 the original position is displayed.

The letters A, B, C on each reel, 5, 6, 7 of FIG. 1 are meant to indicate symbols. For the second selection step where a random number is generated from 0 to 100, and 50 numbers are designated to one display position and 50 to the alternate position (or 60=40 or whatever combination is required) in essence the selection is only from two "elements" (each element comprising 50 random numbers). The prerequisite for the random selection means employed in the present invention is that it be able to select between the same number of elements as there are stopping positions available for the particular selection step, i.e., if three random numbers for a random number generator were mapped to each stopping position, the three random numbers would still constitute only a single element.

It will be appreciated that the frequency of appearance of any symbol or number of symbols can be varied by use of the scheme in accordance with the present invention in a gaming machine. It need not just be applied to a single jackpot symbol. Other types of prize-winning symbols, could be subject of this process, such as "feature" symbols, "bonus" symbols etc.

Further, the scheme of the present invention could be applied to a single reel and a multi-reel machine, more than one of the reels, or even all the reels.

Further, the number of stopping positions on the reels need not be the 20 or 25 described herein, but could be any number.

It will be appreciated by persons skilled in the art that numerous variations and/or modifications may be made to the invention as broadly described. The present embodiments without departing from the spirit or scope of the invention as broadly described. The present embodiments are, therefore, to be considered in all respects as illustrative and not restrictive.

I claim:

1. A gaming machine comprising control means for controlling operation of the machine, display means including a plurality of display positions for displaying combinations of indicia and reward means for returning a reward to a player of the machine in response to certain predetermined indicia combinations being displayed on the display means at the end of a game, the display means including a separate indicia display means for each display position, each indicia display means being responsive to the control means to display an indicium at the end of the game which is selected by the control means from a set of possible indicia, and the control means including indicia selection means for making that selection for each of the display positions, wherein, for at least one display position, a two tier selection process is employed whereby the set of indicia is divided into at least two subsets and the indicia selection means comprises first random number selection means for selecting a random number from a set of random numbers having members each of which uniquely corresponds to one member of a first of said subsets of the set of indicia plus additional numbers each of which uniquely corresponds to one of the remaining subsets of indicia, and second random number selection means, which is invoked only in the event of the first random number selection means selecting a number corresponding to one of said remaining subsets, the second random number selection means being arranged to select a number from a set of numbers each of which uniquely corresponds to one indicia in said one of said remaining subsets of indicia, and the display means being arranged to display the indicium corresponding to the number selected by the first random number selection means if the random number selected by the first random number selection means is a number corresponding to a member of said first of said subsets, and being arranged to display the indicium corresponding to the number selected by the second random number selection means, if the number selected by the first random number selection means is a number corresponding to one of the remaining subsets.

2. A gaming machine in accordance with claim 1, wherein at least one member of at least one of the remaining subsets of indicia is also a member of the first subset of indicia, so that said at least one member is selectable by said first and second random number selection means, and at least one other member of the at least one of the remaining subsets is not a member of the first subset of indicia.

3. A gaming machine in accordance with claim 2, wherein the second random number selection means is arranged to select between members of the at least one remaining subset with unequal probability.

4. A gaming machine in accordance with claim 1, the display means being arranged such that a plurality of associated indicia are displayed at a display position, being the selected indicium and at least one other, associated indicium of the set of indicium, whereby multiple line combinations may be made between the indicia in the plurality of display positions.

5. A gaming machine in accordance with claim 4, the at least one other associated indicium being predetermined and depending on the selected indicium.

6. A gaming machine in accordance with claim 5, wherein, when the selected indicia is selected from the at least one remaining subset, the associated indicia appearing with the selected indicia are of the same appearance independent of which indicia of the remaining subset is selected.

7. A gaming machine in accordance with claim 6, wherein there is a single remaining subset.

8. A gaming machine in accordance with claim 5, wherein there are a plurality of remaining subsets, at least one of the plurality of remaining subsets containing indicia which are different in appearance from each other, and at least one of the other of the plurality of remaining subsets containing indicia which are all of the same appearance to each other.

9. A gaming machine in accordance with claim 8, wherein the members of the plurality of remaining subsets form associated groups, whereby, if one of the indicia from the at least one remaining subset including the indicia of different appearance is selected for display, the one indicia from at least one of the other of the plurality of subsets will also be displayed as an associated indicia.

10. A gaming machine in accordance with claim 9, wherein there are three remaining subsets, each containing two indicia, the first subset containing the rest of the indicia as well as one of the indicia from each of the three remaining subsets.

11. A gaming machine in accordance with claim 9, wherein the second random number selection means is arranged to select between members of the plurality of remaining subsets with unequal probability.

12. A gaming machine in accordance with claim 1, wherein the two tier selection process is employed for a plurality of the display positions.

13. A gaming machine in accordance with claim 12, wherein the indicia selection means is arranged to make the selection of an indicium for at least one display position before making the selection for other display positions, and wherein, if the indicium selected for the at least one display position precludes a predetermined combination of indicia occurring on the display means, then the indicia selection means is arranged not to invoke the second random number selection means for the other display positions of the plurality of display, but, if the first random number generator means for the other display positions of the plurality of display positions selects a member corresponding to one of the said remaining subsets, to display a predetermined indicium from said remaining subset.

14. The gaming machine of claim 13, wherein the indicia selection means is arranged to make the selection of an indicium for each display positions sequentially.

15. The gaming machine of claim 1, wherein the indicia selection means for at least one display positions employs a single tier selection process, the indicia selection means comprising a random number generator for selecting a random number from a set of random numbers having members each of which uniquely correspond to the indicia available for that display, the display means being arranged to display the indicium corresponding to the random number selected.

16. A method of selecting an indicium to be displayed on a gaming machine display, the method comprising dividing a set of possible indicia for display into a plurality of subsets, randomly selecting an element from a set of elements each of which uniquely corresponds to one of the number of indicia in a first of the subsets and the number of remaining subsets, and in the event that the selected element corresponds to one of the remaining subsets further randomly selecting an element from another set of elements corresponding in number to the number of indicia in said one of said remaining subsets and displaying the indicium corresponding to the element selected in said first or second selection, wherein at least one of the indicia in at least one of the remaining subsets is also a member of the first of the subsets, so that said at least one indicium is selectable by said first and second selection step, and at least one other indicium of the at least one remaining subsets is not a member of the first of the subsets.

17. The method of claim 16, wherein, in the second selection, the probabilities of selecting between the indicia in at least one of the remaining subsets are not equal.

18. The method of claim 16, further comprising the step of displaying at least one associated indicium with the selected indicium, the associated indicium being a member of the set of possible indicia.

19. The method of claim 18, wherein the at least one associated indicium to be displayed is predetermined and is dependent on the selected indicium.

20. The method of claim 19, wherein, when the selected indicia is selected from the at least one remaining subset, the associated indicia appearing with the selected indicia are of the same appearance independent of which indicia of the remaining subset is selected.

21. The method of claim 19, wherein there are a plurality of remaining subsets, at least one of the plurality of remaining subsets containing indicia which are different in appearance from each other, and at least one of the other of the plurality of remaining subsets containing indicia which are all of the same appearance to each other.

22. The method of claim 21, wherein the members of the plurality of remaining subsets form associated groups, whereby, if one of the indicia from the at least one remaining subset including the indicia of different appearance is selected for display, then one indicia from at least one of the other of the plurality of subsets will also be displayed as an associated indicia.

23. The method of claim 22, wherein there is a single remaining subset.

24. The method of claim 22, wherein, in the further selection, the probabilities of selecting between the indicia in each of the plurality of remaining subsets are not equal.

25. The method of claim 22, wherein there are three remaining subsets, each containing two indicia, the first subset containing the rest of the indicia as well as one of the indicia from each of the three remaining subsets.

26. A gaming machine comprising control means for controlling operation of the machine, display means including a plurality of display positions for displaying combinations of indicia, the display means including a separate reel display means for each display position, each reel display means comprising a rotatably reel mounting a set of indicia thereon, each reel display means being responsive to the control means to display an indicium at the end of the game which is selected by the control means rom the set of indicia mounted on the rotatable reel, wherein for at least one display positions, a two tier selection process is employed whereby the set of indicia on the reel is divided into at least two subsets, and the control means comprises first selection means for randomly selecting an element from a set of elements each of which uniquely corresponds to one indicium of a first of said subsets of the set of indicia plus additional elements each of which uniquely corresponds to one of the remaining subsets of indicia, and second selection means, which is invoked only in the event of the first selection means selecting an element corresponding to one of the remaining subsets, the second selection means being arranged to randomly select an element from a set of elements each of which uniquely corresponds to one indicium in said one of said remaining subsets of indicia, the reel display means being arranged to display the indicium corresponding to the element selected by the first selection means if the element by the first selection means, is an element corresponding to an indicium which is a member of a first of the subsets, and being arranged to display the indicium corresponding to the element selected by the second selection means, if the number selected by the first selection means is an element corresponding to one of the remaining subsets.

27. A gaming machine in accordance with claim 26, wherein at least one member of at least one of the remaining subsets of indicia also being a member of the first subset of indicia, so that said at least one member is selectable by said first and second selection means and at least one other member of the at least one of the remaining subsets is not a member of the first subset of indicia.

28. A gaming machine in accordance with claim 27, wherein the second selection means is arranged to select between elements of the at least one remaining subset with unequal probability.

29. A gaming machine in accordance with claim 28, wherein a plurality of indicia on a reel are displayed at a display position, being the selected indicium and at least one other indicium adjacent the selected indicium on the reel, whereby multiple line combinations may be made between the indicia in the plurality of display positions.

30. A gaming machine in accordance with claim 29, wherein there are a plurality of remaining subsets, and a corresponding plurality of associated groups are formed by adjacent indicia on the reel, one indicium from each subset being in each associated group.

31. A gaming machine in accordance with claim 30, wherein at least one of the plurality of remaining subsets contain indicia which are different in appearance from each other, and at least one of the other of the plurality of remaining subsets contain indicia which are all of the same appearance to each other.

32. A gaming machine in accordance with claim 31, where one of the remaining subsets contain indicia all of different appearance to each other and all the other remaining subsets contain indicia of the same appearance, so that each associated group on the reel will contain the same indicia as each other apart from the indicia from the one remaining subset.

33. A gaming machine in accordance with claim 32, wherein the second selection means is arranged to select between members of the plurality of remaining subsets with unequal probability.

34. A gaming machine in accordance with claim 32, wherein there are three remaining subsets each containing two indicia, the first subset containing the rest of the indicia as well as one of the indicia from each of the three remaining subsets.

35. A gaming machine in accordance with claim 26, wherein the two tier selection process is employed for a plurality of the display positions.

36. A gaming machine in accordance with claim 35, wherein control means is arranged to make the selection of an indicium for at least one display position before making the selection for other display positions, and wherein, if the indicium selected for the at least one display position precludes a predetermined combination of indicia occurring on the display means, then the indicia selection means is arranged not to invoke the second selector means for the other display positions of the plurality of display, but, if the first selection means for the other display positions of the plurality of display positions selects a member corresponding to one of the said remaining subsets, to display a predetermined indicium from said remaining subset.

37. The gaming machine of claim 35, wherein the control means is arranged to make the selection of an indicium for each display positions sequentially.

38. The gaming machine of claim 26, wherein the control means for at least one display position employs a single tier selection process, the control means comprising a selection means for selecting an element from a set of elements having members each of which uniquely correspond to the indicia available for that display, the display means being arranged to display the indicium corresponding to the random number selected.

* * * * *